US008443479B2

(12) United States Patent
Yamada et al.

(10) Patent No.: US 8,443,479 B2
(45) Date of Patent: May 21, 2013

(54) MULTI-POSITIONABLE MANUAL TOOTHBRUSH

(76) Inventors: Todd H. Yamada, Los Angeles, CA (US); Gregg M. Yamada, Honolulu, HI (US)

( * ) Notice: Subject to any disclaimer, the term of this patent is extended or adjusted under 35 U.S.C. 154(b) by 1334 days.

(21) Appl. No.: 12/180,496

(22) Filed: Jul. 25, 2008

(65) Prior Publication Data

US 2010/0017984 A1 Jan. 28, 2010

(51) Int. Cl.
*A46B 5/02* (2006.01)
*A46B 9/04* (2006.01)
*A46B 7/04* (2006.01)

(52) U.S. Cl.
USPC ..... 15/167.1; 15/144.1; 15/176.1

(58) Field of Classification Search
USPC ..... 15/167.1
IPC ..... A46B 9/04
See application file for complete search history.

(56) References Cited

U.S. PATENT DOCUMENTS

| | | | | |
|---|---|---|---|---|
| 4,693,622 | A * | 9/1987 | Booth | 401/191 |
| 5,350,248 | A * | 9/1994 | Chen | 401/195 |
| 5,442,831 | A | 8/1995 | Yamada | |
| 5,706,545 | A * | 1/1998 | Yamada | 15/172 |
| 5,815,875 | A | 10/1998 | Yamada | |
| 6,385,808 | B1 * | 5/2002 | Yamada et al. | 15/167.1 |
| 2003/0115693 | A1 * | 6/2003 | Grez et al. | 15/22.1 |
| 2004/0250366 | A1 * | 12/2004 | Park | 15/167.1 |
| 2005/0108841 | A1 * | 5/2005 | Edwards | 15/167.1 |

FOREIGN PATENT DOCUMENTS

| | | |
|---|---|---|
| CA | 2287073 | 10/1998 |

* cited by examiner

*Primary Examiner* — Monica Carter
*Assistant Examiner* — Stephanie N Berry
(74) *Attorney, Agent, or Firm* — Arent Fox LLP

(57) ABSTRACT

A multi-positionable manual toothbrush includes a toothbrush body, a toothbrush head, and a spring capable of engaging the toothbrush head at a plurality of angles with respect to the toothbrush body.

18 Claims, 3 Drawing Sheets

MULTI-POSITIONABLE MANUAL TOOTHBRUSH

BACKGROUND

1. Field

The present disclosure relates generally to brushes, and more particularly, to a multi-positional manual toothbrush configured to be highly effective alternative to traditional manual toothbrushes.

2. Background

Manual toothbrushes are designed to have either a straight or an angled solid structure. The straight design may present a better or easier option for reaching certain portions of the teeth, while the angled structure design allows a user to reach behind otherwise difficult portions of the teeth. Certainly a toothbrush that allows manual manipulation between the two designs will permit a person to attain the most effective and successful method of plaque removal.

SUMMARY

One aspect of a multi-positionable manual toothbrush is disclosed. A multi-positionable manual toothbrush includes a toothbrush body, a toothbrush head, and a spring capable of engaging the toothbrush head at a plurality of angles with respect to the toothbrush body.

In another aspect of the disclosure, a multi-positionable manual toothbrush includes a a flexible joint, a toothbrush body, a toothbrush head operatively connected to the toothbrush body by said flexible joint, a button mounted to the toothbrush body, and a spring operatively connected between the toothbrush head and the button.

A method for operating a multi-positionable manual toothbrush is also disclosed. The method includes applying manual force to a toothbrush head in relation to a toothbrush body, locking said toothbrush head into a different operational angle from an initial position, and activating a button coupled to the toothbrush head by a spring mechanism, thereby returning the toothbrush head to the initial position.

It is understood that other aspects of the invention will become readily apparent to those of ordinary skill in the art from the following detailed description, wherein it is shown and described only various aspects of the invention by way of illustration. As will be realized, the invention is capable of other and different configurations and its several details are capable of modification in various other respects, all without departing from the scope of the invention. Accordingly, the drawings and detailed description are to be regarded as illustrative in nature and not as restrictive.

BRIEF DESCRIPTION OF DRAWINGS

Various aspects of the present invention are illustrated by way of example, and not by way of limitation, in the accompanying drawings, wherein.

DETAILED DESCRIPTION

The detailed description set forth below in connection with the appended drawings is intended as a description of various embodiments of the present invention and is not intended to represent the only embodiments in which the present invention may be practiced. The detailed description includes specific details for the purpose of providing a thorough understanding of the present invention. However, it will be apparent to those skilled in the art that the present invention may be practiced without these specific details.

Figure 1:
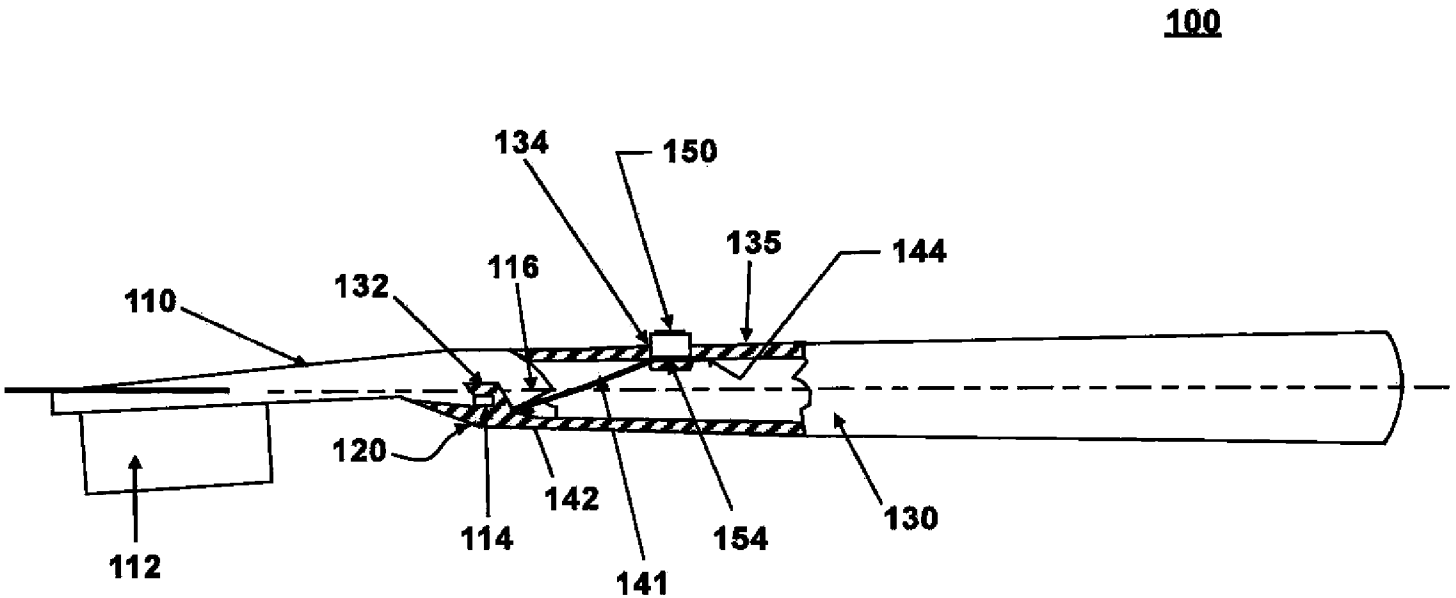
FIG. 1 illustrates a side view of a multi-positionable manual toothbrush.

FIG. 1 illustrates a side view of a multi-positionable manual toothbrush 100. The multi-positionable manual toothbrush 100 is comprised of a toothbrush head 110 connected to a toothbrush body 130 via a rotatable joint 120. The toothbrush head 110 may further comprise a bristle section 112, knuckles 114 and a spring slot 116. The knuckles 114 may snap-fit into claws 132 integrally formed with the toothbrush body 130. The toothbrush head 110 may be replaceable by the user after prolonged use by uncoupling the claws 132 on the toothbrush body 130 from the knuckles 114 on the toothbrush head. The rotatable joint 120 may allow for the adjustability of the toothbrush head 110 to any angle, but typical operation may lie between 0 and 35 degrees. This adjustment in the operational axis of the toothbrush head may be implemented by utilizing a spring mechanism working in association with the spring slot 116 and a release button 150 provided in an opening 134 on a peripheral surface 135 of the toothbrush body 130.

Figure 2A:
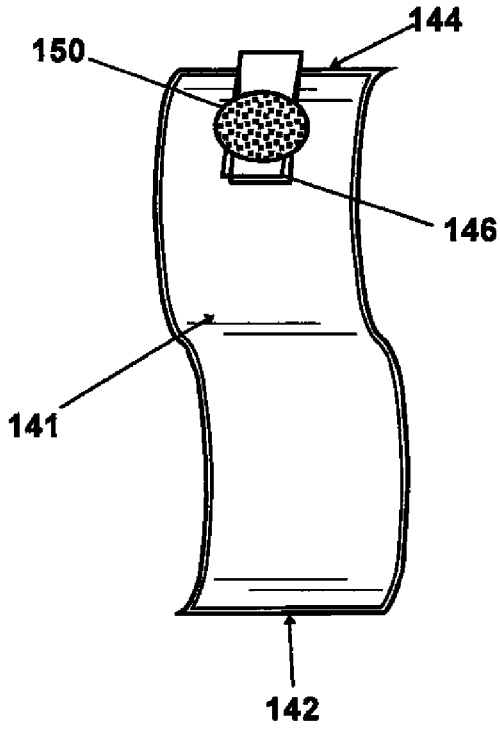
FIG. 2A illustrates a top view of a leaf spring and button.
Figure 2B:
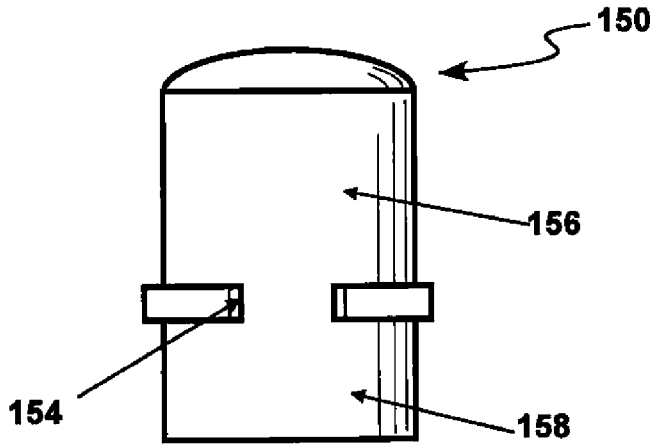
FIG. 2B illustrates a side view of a release button.

The spring mechanism may be a leaf spring 141, for example, that is disposed lengthwise in a longitudinal direction of the toothbrush body 130, having an end 142 fitted into the spring slot 116 on the toothbrush head and another end 144 that engages a slotted section 154 in the release button 150 (see also FIGS. 2A and 2B). The leaf spring 141 may be comprised of any non-corrosive material including aluminum, titanium, or stainless steel, for example. Furthermore, the leaf spring 141 may be formed in any shape so as to supply the required spring constant to frictionally support end 142 in the spring slot 116 while coupled with the release button 150. FIG. 1, for example, shows a parabolic leaf spring 141 formed in the shape of a parabola, but arc leaf springs or any other variety of leaf spring may be employed.

FIG. 2A illustrates a top view of the variation of parabolic leaf spring 141 depicted in FIG. 1. The parabolic leaf spring 141 may be generally rectangular in shape with an end 142 for insertion in the spring slot 116 and an end 144 for engaging the release button 150. End 144 further comprises a slot 146 for straddling the slotted section 154 of the release button 150. The width and thickness, along with the material properties, of the leaf spring 141 may be varied to supply a particular spring constant, or stiffness, to the spring.

FIG. 2B illustrates a side view of release button 150. The release button 150 may be cylindrical in shape, for example, and designed to fit into an opening 134 on a peripheral surface 135 of the toothbrush body 130. The side view shows slotted section 154, which may be an area of reduced diameter that divides the release button 150 into an upper section 156 and a lower section 158.

As shown in FIG. 1, the release button 150 may be inserted through opening 134 so that slotted section 154 is disposed interior to the peripheral surface 135. The leaf spring 141 may be placed so that slot 146 straddles the slotted section 154 of the release button 150. A small portion of end 144 may extend beyond the release button 150 and engage an inner wall of the peripheral surface 135. In this manner, both ends 142 and 144 of leaf spring 141 are engaged. The spring constant of the leaf spring 141 applies sufficient downward force via end 142 on a surface of the spring slot 116 for maintaining the toothbrush head 110 in an initial zero-degree position. At the same time, the leaf spring 141 supports the release button 150 in position and prevents the button from being ejected through the opening 134 because the diameter of the lower section 158 of the button is wider than the width of the slot 146 in the leaf spring 141 (see FIG. 2A).

Figure 3:
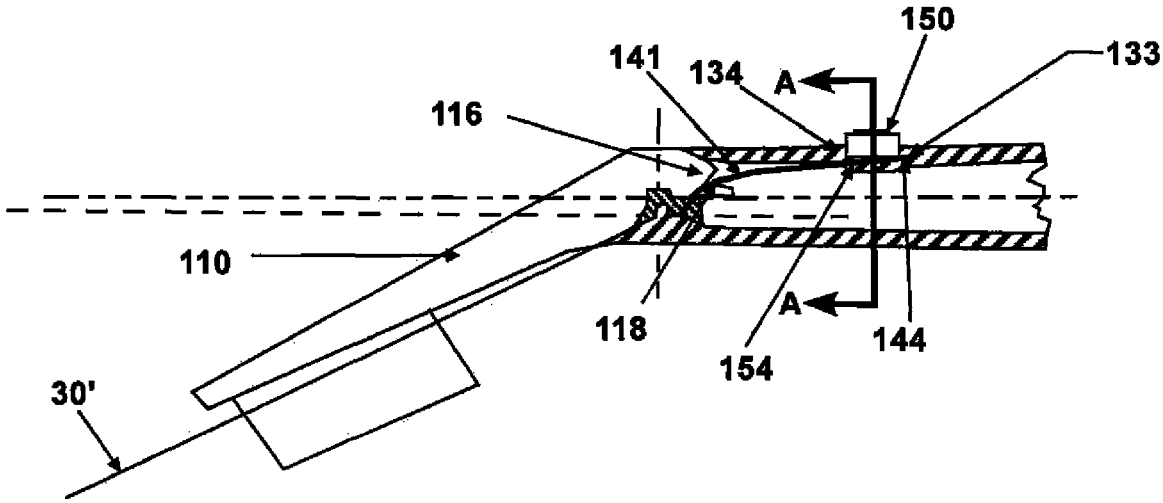
FIG. 3 illustrates a side perspective view of a multi-positionable manual toothbrush in an angularly extended position.

FIG. 3 illustrates a side perspective view of the spring mechanism, comprised of the leaf spring 141, the insertion slot 116, and the release button 150. As the brush head 110 is depressed downward to engage a second operational axis, the interior surface of slot 146 in the end 144 of the leaf spring 141 is initially compressed against the slotted section 154 of the release button 150. As the toothbrush head 110 continues to rotate, the leaf spring 141 bends past the point of inflection in the parabolic form and is pulled toward the brush head 110. The slot 116 may be designed with a lip 118 for engaging the spring 141 to further enable this motion. The end 144 of the leaf spring 141 is pulled through the slotted section 154 of the release button 150. The sliding process of the leaf spring 141 allows the end 144 of spring 141 to clear an edge 133 of the opening 134 and thus push the release button 150 upward. The button 150 is thereby engaged in its up position since the spring 141 is unable to slide backwards as a result of the edge 133 of the opening 134. Since the leaf spring 141 is now under a load, by pushing downward on the release button 150 the spring 141 is disengaged and released. This process allows the spring 141 to slide backwards within the slotted section of the release button 150. As the spring 141 slides back to its initial position, the brush head 110 rotates back to its original straight position, i.e., zero degrees with respect to the toothbrush body 130. The design allows the multi-positionable manual toothbrush 100 to efficiently operate at its initial position and at at least one other operational angle.

The multi-positionable toothbrush 100 may enable a user to efficiently operate the toothbrush 100 at more than one operational angle. By manually rotating the toothbrush head 110 away from the zero-degree centerline position, a user may force the spring 141 to slide toward the head 110 until the end 144 of the spring 141 clears an edge 133 of an opening 134 in a peripheral surface 135 of the toothbrush body 130. In so doing, the leaf spring 141 engages the release button 150 in an up position with the spring 141 now under a load. At the instant the user likewise depresses the button 150, the spring 141 will decompress and return the multi-positionable manual toothbrush 100 to its original position.

The previous description is provided to enable any person skilled in the art to practice the various embodiments described herein. Various modifications to these embodiments will be readily apparent to those skilled in the art, and the generic principles defined herein may be applied to other embodiments. Thus, the claims are not intended to be limited to the embodiments shown herein, but is to be accorded the full scope consistent with the language claims, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. A muitipositionaIe manual toothbrush, comprising:

a toothbrush body;

a button coupled to the toothbrush body through a hole in the tooth brush body having at least one edge;

a toothbrush head coupled to the toothbrush body; and a leaf-type spring operable by the button configured to engage and retain the toothbrush head at a plurality of angles with respect to the toothbrush body when an end of the spring slidably clears and engages the edge of the hole and pushes the button into an upward position.

2. The multi-positionable manual toothbrush of claim 1, wherein the button on the toothbrush body is configured to reset the toothbrush head to a common axial orientation with the toothbrush body.

3. The multi-positionable manual toothbrush of claim 2, further comprising a slot in the toothbrush head, wherein the spring is configured to insert into the slot.

4. The multi-positionable manual toothbrush of claim 3, wherein the spring is configured between the slot and the button to reset the toothbrush head into the axial orientation once the button is depressed.

5. The multi-positionable manual toothbrush of claim 4, further comprising a slotted section in the button for slidably engaging the spring.

6. The multi-positionable manual toothbrush of claim 1, wherein the spring comprises non-corrosive material consisting of aluminum, titanium or stainless steel.

7. The multi-positionabie manual toothbrush of claim 1, wherein the spring is configured to compress upon the toothbrush head being placed into an angled position and decompress upon the button being depressed.

8. The multi-positionable manual toothbrush of claim 1, wherein at least one of the plurality of angles is within 30-35 degrees with respect to the toothbrush body.

9. The multi-positionable manual toothbrush of claim 1, wherein the toothbrush head is replaceable.

10. A multi-positionable manual toothbrush, comprising:

a flexible rotatable joint;

a toothbrush body;

a toothbrush head operatively connected to the toothbrush body by the flexible rotatable joint;

a button mounted to the toothbrush body through a hole having at least one edge; and a leaf-type spring operatively connected between the toothbrush head and the button, wherein the spring is configured to engage and retain the toothbrush head at a plurality of angles with respect to the toothbrush body when an end of the spring slidably clears and engages the edge of the hole and pushes the button into an upward position.

11. The multi-positionable manual toothbrush of claim 10, further comprising a slot in the toothbrush head, wherein the spring is configured to insert into the slot.

12. The multi-positionable manual toothbrush of claim 11, wherein the spring is configured between the slot and the button to reset the toothbrush head into the axial orientation once the button is depressed.

13. The multi-positionable manual toothbrush of claim 12, further comprising a slotted section in the button for slidably engaging the spring.

14. The multi-positionable manual toothbrush of claim 10, wherein the spring comprises non-corrosive material consisting of aluminum, titanium or stainless steel.

15. The multi-positionable manual toothbrush of claim 10 wherein the spring is configured to compress upon the toothbrush head being placed into an angled position and decompress upon the button being depressed.

16. The multi-positionable manual toothbrush of claim 10, wherein at least one of the plurality of angles is within 30-35 degrees with respect to the toothbrush body.

17. The multi-positionable manual toothbrush of claim 10, wherein the toothbrush head is replaceable.

18. The multi-positionable manual toothbrush of claim 10, further comprising at least one claw integrally formed with the toothbrush body and at least one knuckle formed on the toothbrush head, wherein the flexible rotatable joint is configured by snap-fitting the at least one knuckle into the at least one claw.

* * * * *